US005390761A

United States Patent [19]

Perry

[11] Patent Number: 5,390,761

[45] Date of Patent: Feb. 21, 1995

[54] LATCH FOR SCAFFOLDING

[76] Inventor: Eugene D. Perry, P.O. Box 306, Mooresville, Ind. 46158

[21] Appl. No.: 124,809

[22] Filed: Sep. 21, 1993

[51] Int. Cl.[6] ..... E06C 7/18

[52] U.S. Cl. ..... 182/118; 248/248; 292/151; 292/163

[58] Field of Search ..... 248/243, 351; 182/118, 182/179; 292/163, 175, 157, 150, 151

[56] References Cited

U.S. PATENT DOCUMENTS

| | | | |
|---|---|---|---|
| 2,935,033 | 5/1960 | Dunlap | 292/163 X |
| 3,396,817 | 8/1968 | Perry | 182/187 |
| 4,159,838 | 7/1979 | Wilzig et al. | 292/150 |
| 4,262,774 | 4/1981 | Chez | 182/179 |
| 4,793,438 | 12/1988 | Perry | 182/112 |

OTHER PUBLICATIONS

SONNY SCAFFOLDS, INC. "Better than the Best" Brochure, 1988.

SONNY'S FIRST* SCAFFOLDS Brochure, 1990 (Double Sided).

*Primary Examiner*—Ramon O. Ramierz

*Attorney, Agent, or Firm*—Barnes & Thornburg

[57] ABSTRACT

The invention relates to a latch mechanism for coupling a horizontal platform at a selected vertical position on a supporting structure, wherein the mechanism includes a frame member having a plurality of walls arranged to define an enclosed area and a multi-sided bracket for engaging the supporting structure to couple the frame member to the supporting structure. A locking bar extends through the frame member and bracket to engage with the supporting member and is movable between a locking position and an unlocking position. A blocking plate is coupled to the frame member and positioned outside of the enclosed area and is movable by gravity between a blocking position to prevent movement of the locking bar to the unlocking position and a releasing position to allow movement of the locking bar to the unlocking position. The blocking plate includes a aperture aligned for receiving the locking means when in the unlocking position, which aperture is moved downwardly by gravity forces to present a solid portion in alignment with the locking bar when the locking bar is moved to the locking position, thus preventing the locking bar from being withdrawn into the blocking plate and out of the support structure.

24 Claims, 2 Drawing Sheets

LATCH FOR SCAFFOLDING

BACKGROUND AND SUMMARY OF THE INVENTION

The present invention relates to scaffolds and particularly to latch mechanisms for attaching scaffold platform trusses to supporting structures which are conventionally two vertical ladders. More particularly, the invention relates to scaffold latch mechanisms that lock in a locking position and include a blocking mechanism to maintain the latch mechanism in the locking position. A typical scaffold is a prefabricated, modular, mobile, rectangular work platform on wheeled, locking casters. A scaffold typically comprises two vertical ladders each having two vertical legs connected by five horizontal rungs, caster stems inserted into bushings located at the bottom of each ladder leg, and two horizontal trusses attached to the vertical ladders to form a rectangular frame. Each horizontal truss is formed to provide an interior ledge on the long axis of the horizontal truss. The platform upon which the user (worker) stands is supported on the truss ledges. The overall dimensions of the rectangular frame can be altered by using different length vertical ladders, horizontal trusses and platforms.

The present invention is a latch mechanism for attaching the horizontal trusses to the vertical ladders.

Scaffolding is used in many applications to provide an elevated support surface for workers. Originally, scaffolding was made from timber, but in recent times metal has become the material of choice for manufacturing scaffolding. Metal scaffolding typically includes a pair of vertical legs and a plurality of horizontal rungs extending between the support legs to form a ladder-like supporting structure. Horizontal platforms extend between, and are attached to, a pair of the ladder-like supporting structures.

Various methods have been used to attach the horizontal platforms or platform trusses to the supporting structures. One widely used method for attaching the platforms to the supporting structures is to provide a framework for the platforms and to form apertures in the platform framework and in the vertical legs of the supporting structure. When the apertures in the platform framework and the vertical legs of the supporting structure are aligned, latch pins can be inserted through the apertures to hold the platform in position relative to the supporting structure. In this description, and in the appended claims, terms such as "frame member" or "horizontal platform framework" are intended broadly to refer to frameworks, trusses or support members for supporing a work platform.

It is known that in the ordinary use of the scaffolding, movement of workers on the platform can cause the supporting structure to move relative to the platform. This relative movement sometimes caused the latch pin to "walk" out of the apertures. Unfortunately, there has been no way to determine whether the latch pin is "walking" out of the apertures except by close visual scrutiny. When the latch pin walked far enough, the platform framework was no longer attached to the supporting structure.

One method for solving the walking problem is disclosed in U.S. Pat. No. 3,396,817 issued to Perry on Aug. 13, 1968. Perry solved the walking problem by rigidly attaching a threaded disk to the latch pin and rigidly attaching a threaded nipple to the platform framework. The threaded disk engages the threaded nipple to hold the latch pin in position in the apertures. However, human nature being what it is, workers oftentimes ignored the threading mechanism, and the latch pins were still allowed to walk out of the apertures.

A latch mechanism was needed that could positively hold a latch pin in position without the use of a threaded disk and nipple. One such latch pin is disclosed in U.S. Pat. No. 4,793,438 issued to Perry on Dec. 27, 1988. The Perry '438 patent discloses a latch pin that is biased by a spring to extend through the aligned apertures in the platform framework and the supporting structure. A release lever engages the latch pin to move the latch pin against the biasing force of the spring in order to disengage the latch pin from the supporting structure.

Unfortunately, this mechanism does not provide a positive indication that the latch pin is properly positioned. Moreover, due to the number of parts, the mechanism was expensive to manufacture. A less expensive and more easily manufacturable latch mechanism is desirable. Furthermore, a latch mechanism that provides a positive indication of the latch pin position and combines the threaded disk and nipple with an automatic blocking mechanism for maintaining the latch pin in a locking position would be a substantial improvement over conventional scaffolding latch mechanisms.

According to the present invention, a latch mechanism for use in coupling a horizontal platform to a vertically extending supporting structure comprises a frame member and means for locking the frame member to the supporting structure. The locking means is coupled to the frame member and is movable between a locking position and an unlocking position. The mechanism also includes means for selectively blocking the locking means in the locking position. The blocking means is coupled to the frame member and includes aperture means for receiving the locking means and means for coupling the blocking means to the frame member. The blocking means is movable between a releasing position for allowing the locking means to move to the unlocking position and a blocking position for retaining the locking means in the locking position.

The frame member includes an engaging member for engaging the supporting structure and a plurality of walls arranged to define an enclosed area. First and second walls of the plurality of walls are positioned in parallel spaced-apart relation perpendicular to the longitudinal axis of the engaging member and include apertures for receiving the locking means. The locking means includes a latch pin positioned inside the enclosed area and positioned between the first and second walls to extend through the apertures in the first and second walls.

The coupling means includes a housing member coupled to the first wall and positioned outside the enclosed area and means for attaching the housing member to the first wall. The housing member defines a channel and includes an aperture coaxially aligned with the apertures in the first and second walls for receiving the latch pin when the latch pin is in the unlocking position. When attached to the first wall, the housing member and the first wall cooperate to form a cavity therebetween.

According to one aspect of the invention, the locking means includes an internally threaded disk rigidly attached to the latch pin and an externally threaded nipple rigidly attached to the second wall. The threaded disk engages the threaded nipple to hold the latch pin in the locking position.

According to another aspect of the invention, the blocking means includes means for visually indicating the position of the latch pin when the latch pin is in the locking position. The indicating means includes a plate positioned in the cavity and sized and oriented for movement by gravity actuation from a latch pin-releasing position to a latch pin-blocking position. The plate includes a solid portion, an elongated aperture and a distal end. The means for coupling the housing member to the first wall includes means for limiting the amount of movement of the plate wherein the limiting means extends from the housing member through the elongated aperture to the first wall.

The elongated aperture can be aligned with the apertures in the housing member and the first and second walls to permit movement of the latch pin between the locking position and the unlocking position. When the solid portion is aligned with the apertures in the housing member and the first and second walls, the latch pin is prevented from moving out of the locking position. At the same time, the distal end extends beyond the cavity to provide a visual indication that the latch pin is in the locking position.

By providing a plate member having a solid portion and an elongated aperture, the present invention selectively blocks the latch pin from walking out of the locking position. By providing a distal end of the plate for extending beyond the cavity when the latch pin is in the locking position, the present invention also provides a positive visual indication of the position of the latch pin.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
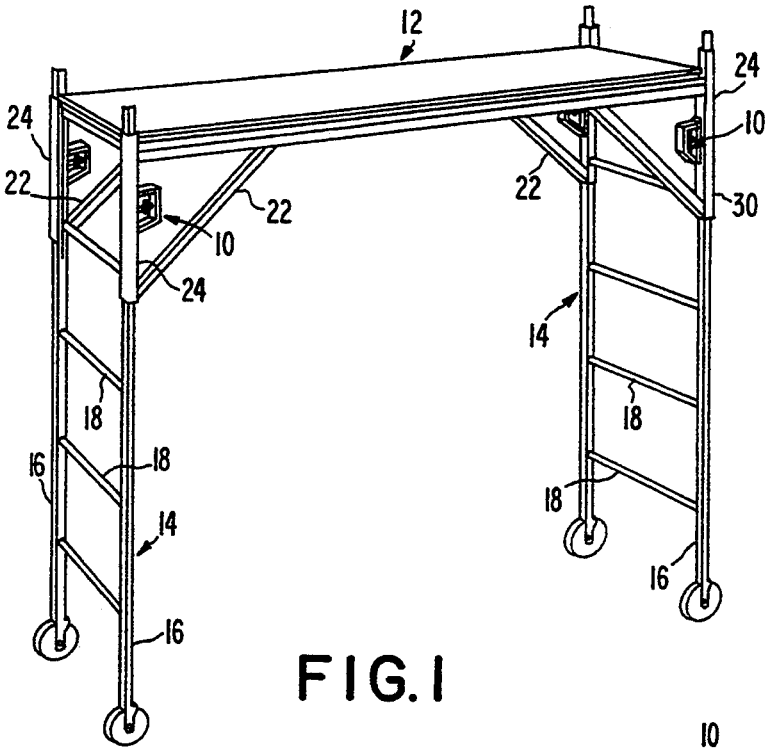
FIG. 1 is a perspective view of a scaffold incorporating the present invention for coupling a working platform to-a supporting structure.

A latch mechanism 10 for use in coupling a working platform 12 to a supporting structure 14 is shown in FIGS. 1, 2, and 4–6. Referring to FIG. 1, the supporting structure 14 includes a plurality of vertical legs 16 and a plurality of horizontal rungs 18 extending between, and attached to, the vertical legs 16. In the illustrative embodiment, adjacent pairs of vertical legs 16 with the rungs 18 therebetween provide a ladder-like support structure 14 at each end of the scaffold. The working platform 12 includes a working surface 20 attached to, and supported by, a plurality of truss members 22 and a plurality of vertical engaging members 24 which are configured to engage the vertical legs 16 of the supporting structure 14.

Figure 2:
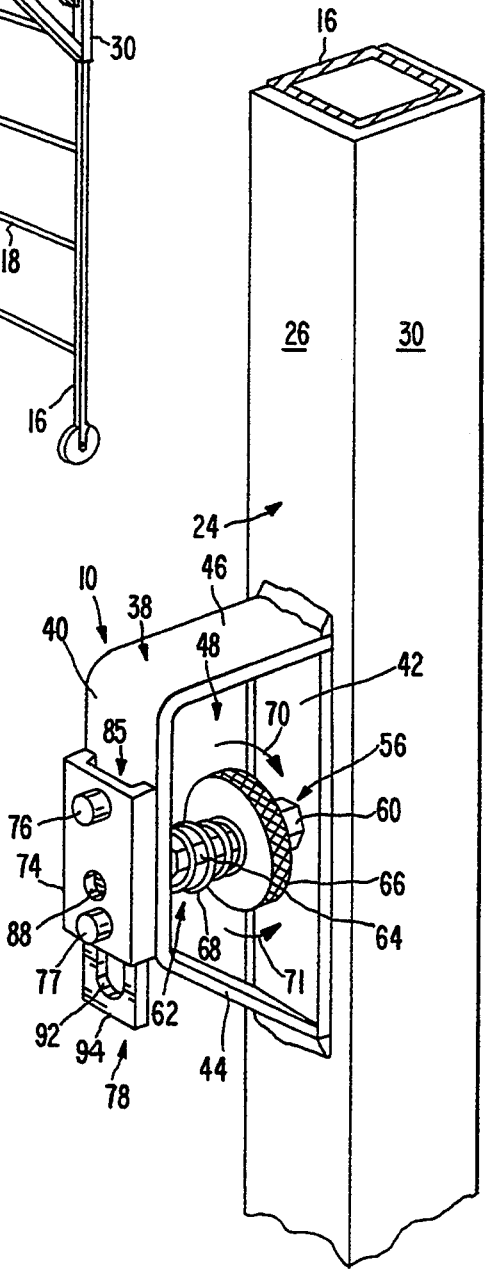
FIG. 2 is a perspective view of a latch mechanism according to the present invention including an engaging member for engaging the supporting structure and a frame member coupled to the engaging member, wherein the frame member defines an enclosed area and a latch pin having a threaded disk is positioned therein to engage the frame member and the supporting structure, a housing member coupled to the frame member to form a cavity therebetween, and a plate positioned in the cavity to selectively block the latch pin from moving out of engagement with the supporting structure and provide a visual indication that the latch pin is in the locking position.

Referring to FIG. 2, the vertical engaging members 24 are illustratively U-shaped in horizontal cross section and include first and second engaging walls 26, 28 extending perpendicularly from the edges of a base engaging wall 30 (FIG. 2). The vertical legs 16 illustratively have a generally square horizontal cross section and the U-shaped engaging members 24 are configured to loosely fit around three sides of the square vertical legs 16. The loose fit allows the engaging members 24 to be easily moved up and down the vertical legs 16 as required to position the working platform 12 at a desired elevation. As shown most clearly in FIGS. 4–6, the wall 34 of the vertical leg 16 that lies adjacent the first engaging wall 26 includes a plurality of vertically spaced apart apertures 32 (only one of which is shown) and the first engaging wall 26 includes a threaded aperture 36. The apertures 32, 36 are positioned in the same vertical plane so that aperture 36 comes into alignment with apertures 32 as the engaging member 24 is moved up and down the vertical leg 16.

Figure 4:
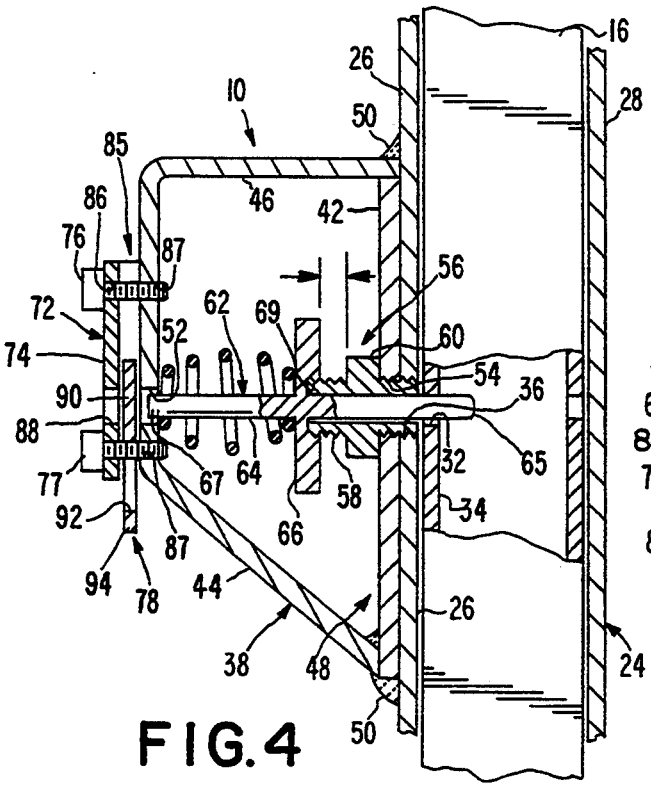
FIG. 4 is a side sectional view of the latch mechanism of the present invention showing the latch pin engaged with the supporting structure and the threaded disk engaged with a threaded nipple coupled to the frame member and the plate positioned to block movement of the latch pin from the engaged position.
Figure 5:
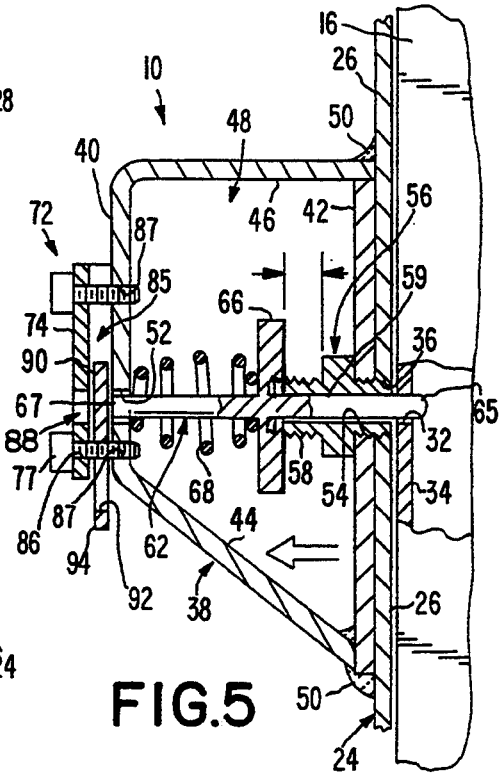
FIG. 5 is a side sectional view similar to FIG. 4 showing the latch pin engaged with the supporting structure and the threaded disk disengaged from the threaded nipple, the latch pin being blocked from further movement from the engaged position by the position of the plate.
Figure 6:
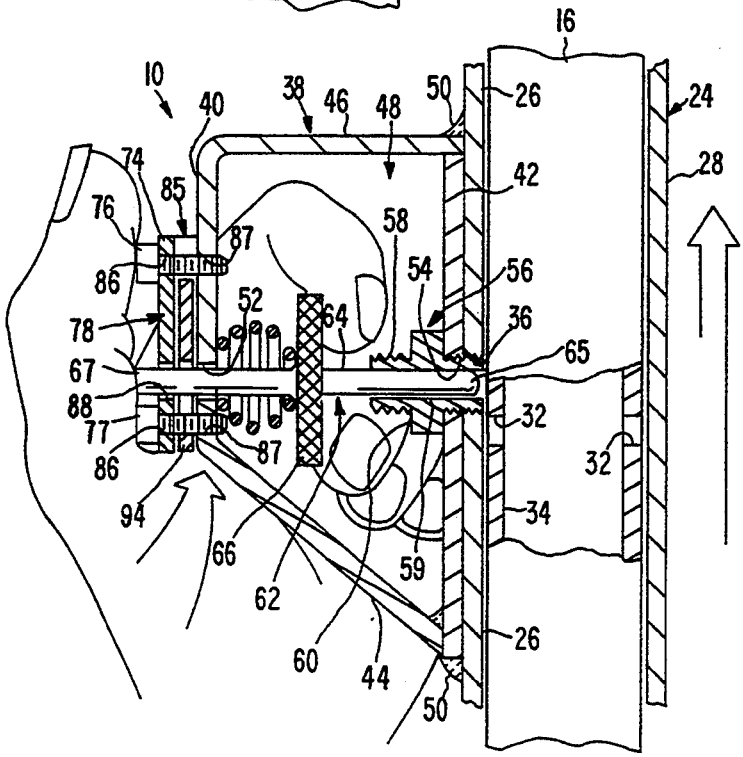
FIG. 6 is a side sectional view similar to FIG. 4–5 showing a worker's hand moving the plate upwardly to align the elongated aperture with the latch pin while simultaneously grasping the threaded disk to move the latch pin from the engaged position.

The latch mechanism 10 further includes a frame member 38 having first, second, third, and fourth walls 40, 42, 44, 46, respectively, arranged to define an enclosed area 48. The first and second walls 40, 42 are positioned in parallel spaced-apart relation with the second wall 42 being attached to the first engaging wall 26, illustratively by welds 50. The third and fourth walls 44, 46, connect the first and second walls 40, 42. As seen in FIGS. 4–6, the third wall 44 extends between the first and second walls 40, 42 at an acute angle thereto and the fourth wall 46 extends orthogonally to the first and second walls 40, 42.

Referring to FIGS. 4–6, the first and second walls 40, 42 include coaxially aligned apertures 52, 54, respectively. The aperture 54 in the second wall 42 is threaded and coaxially aligned with the threaded aperture 36 formed in the first engaging wall 26. The threaded apertures 36, 54 cooperate to form a continuous and unbroken thread pattern extending from the enclosed area 48 through the first engaging wall 26.

A nipple 56 is positioned inside the enclosed area 48 and is attached to the second wall 42 of the frame member 38. The nipple 56 includes an externally threaded rod 58 having a central bore 59 extending longitudinally therethrough and a hexagonally shaped nut 60 externally centered on the rod 58. The nipple 56 is threadedly inserted into the apertures 36, 54 until the hexagonal nut 60 contacts and is wedged against the second wall 42, thereby rigidly attaching the nipple 56 to the second wall 42 and the engaging member 24.

A latch pin 62 is also positioned inside the enclosed area 48 and includes a rod 64 having first and second ends 65, 67, respectively, and an internally threaded disk 66 longitudinally centered on the rod 64. The latch pin 62 has a diameter slightly smaller than the diameter of the central bore 59 of the nipple 56. The internal threads 69 (FIG. 4) of the disk 66 are complementary to the external threads of the nipple 56. The latch pin 62 is positioned, and has sufficient length, so that the first end 65 extends through the aperture 32 formed in the wall 34 of the vertical leg 16 and the second end 67 extends through the aperture 52 formed in the first wall 40 at the same time. A biasing spring 68 is compressibly positioned between the first wall 40 of the frame member 38 and the threaded disk 66, urging the latch pin 62 into the central bore 59 and away from aperture 52 in the first wall 40.

The latch pin 62 can be inserted into the central bore 59 of the nipple 56 to extend into the aperture 32, and the disk 66 can be rotated in a first direction 70 (FIG. 2) to lock the latch pin 62 in position in the aperture 32 to provide a deadbolt function locking the frame member 38 and the engaging member 24 in a selected vertical position on the supporting structure 14. Rotating the threaded disk 66 in a second direction 71 opposite to the first direction 70 (FIG. 2) unlocks the latch pin 62 from its position in aperture 32. However, even though the latch pin 62 is unlocked the latch pin 62 cannot be withdrawn from aperture 32.

A blocking means 72 is provided to prevent the latch pin 62 from completely withdrawing from the aperture 32. The blocking means 72 includes a housing member 74 attached to the first wall 40 by bolts 76, 77, or other suitable attachment means, and a plate 78. The plate 78 is movable between a latch pin-blocking position, as shown in FIGS. 2, 4, and 5, and a latch pin-releasing position, as shown in FIG. 6.

Figure 3:
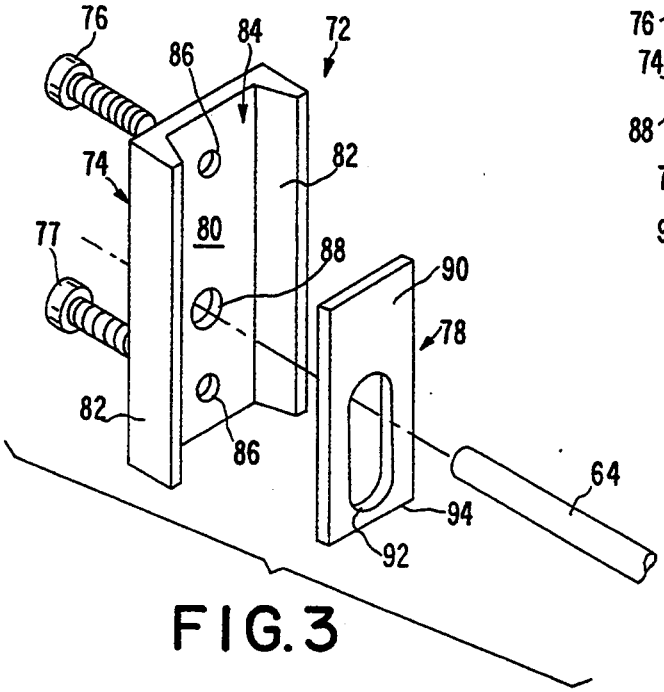
FIG. 3 is an exploded perspective view showing the relation of the housing member, latch pin, and plate shown in FIG. 2 and showing the elongated aperture and solid portion of the plate.

The housing member 74 includes a base 80 and a pair of parallel side walls 82 which extend orthogonally from the base 80 to define a longitudinally extending channel 84 (FIG. 3). When the housing member 74 is attached to the first wall 40, the channel 84 forms a longitudinally extending cavity 85 (FIGS. 4–6). The base 80 includes bolt-receiving apertures 86 and a latch pin rod-receiving aperture 88. When the housing member 74 is positioned against the first wall 40, the bolts 76, 77 extend through the bolt-receiving apertures 86 in the housing member 74 and through the cavity 85 to engage bolt-receiving apertures 87 formed in the first wall 40.

The plate 78 includes a solid portion 90, an elongated aperture 92, and a lower distal end 94. The plate 78 is sized to loosely fit inside the cavity 85, thereby allowing the plate 78 to move longitudinally vertically inside the cavity 85. When the plate 78 is positioned completely in the cavity 85, the second bolt 77 is inserted through the aperture 86 in the housing member 74, through the elongated aperture 92 in the plate 78, and into the aperture 87 in the first wall 40. Thus, the second bolt 77 cooperates with the elongated aperture 92 to hold the plate 78 in the cavity 85, to limit the amount of movement of the plate 78 within the cavity, and to determine how far the distal end 94 can extend beyond the cavity 85.

The operation of the latch mechanism 10 of the present invention can be understood by reference to FIGS. 4–6. In FIG. 4, the latch mechanism 10 is shown in the locking position. The first end 65 of the latch pin 62 extends through the nipple 56 and the aperture 32 in the vertical leg 16, maintaining the engaging member 24, and therefore the working platform 20 (FIG. 1), in a selected vertical position relative to the supporting structure 14. The threaded disk 66 is threadedly engaged with the nipple 56 to provide a locking means for keeping the latch pin 62 in the locking position. When the latch pin 62 is in the locking position, the plate 78 is free to move by force of gravity to the blocking position, as shown in FIGS. 4–5. In the blocking position, as best shown in FIG. 2, the distal end 94 of the plate 78 extends beyond the cavity 85 to provide a visual indication that the latch pin is in the locking position.

To unlock the latch pin 62 and remove or reposition the engaging member 24 vertically relative to the supporting structure 14, the threaded disk 66 is rotated in the second direction 71 (FIG. 2) to disengage the disk 66 from the nipple 56. As seen in FIG. 5, the disk 66 can be completely disengaged from the nipple 56, but the solid portion 90 of the plate 78 still blocks movement of the first end 65 out of the aperture 32 in the vertical leg 16. Thus, the plate 78 provides a blocking means to keep the latch pin 62 in the locking position without regard to the engagement status of the threaded disk 66 and the nipple 56.

In order to proceed with disengaging the latch pin 62 from the vertical leg 16, a worker must push the plate 78 upwardly into the cavity 85 to a latch pin-releasing position, as shown in FIG. 6. With the plate 78 in the latch pin-releasing position, the elongated aperture 92 is aligned with the second end 67 of the latch pin 62 and the worker can grasp the threaded disk 66 and pull the latch pin 62 toward the first wall 40 against the spring 68. Since the elongated aperture is aligned with the aperture 88 in the base 80, the first end 65 can be completely withdrawn from the aperture 32 in the vertical leg 16, as shown in FIG. 6.

When the first end 65 is clear of the aperture 32, the engaging member 24 is free to be vertically repositioned on the supporting structure 14. When the engaging member 24 has been repositioned to the new desired position, the worker need only release the latch pin 62 and move the engaging member 24 up and down relative to the vertical leg 16. When the latch pin 62 is aligned with one of the apertures 32 in the vertical leg 16, the biasing spring 68 will urge the first end 65 into the aperture 32, thereby reestablishing a locking position. The operator can then rotate the disk 66 in the first direction 70 (FIG. 2) to engage the nipple 56 to lock the latch pin 62 in the locking position. When the operator removes his or her hand from the frame 38, the plate 78 is free to fall under the force of gravity to the blocking position, shown in FIGS. 2, 4–5, and provide the visual indication of the locked condition of the latch pin.

Advantageously, as shown in FIG. 6, the acute angle between the third wall 44 and the first and second walls 40, 42 provides an ergonomic means for the worker to move the plate 78 into the cavity 85 while simultaneously grasping the threaded disk 66 and pulling the latch pin 62 out of the locking position. However, it will be appreciated that other shapes can be used for the frame member 38, such as rectangular or circular.

Although the invention has been described in detail with reference to a certain preferred embodiment, variations and modifications exist within the scope and spirit of the invention as described and defined in the following claims.

I claim:

1. A latch mechanism for use in coupling a horizontal platform to a selected vertical position on a supporting structure, the mechanism comprising:

a frame member, means for locking the frame member to the supporting structure, the locking means being coupled to the frame member and movable between a locking position engaging the supporting structure and an unlocking position disengaging the supporting structure, and means for selectively blocking the locking means in the locking position, the blocking means being coupled to the frame member and including first means therein for passage of a portion of the locking means.

2. The mechanism of claim 1, further comprising means for coupling the blocking means to the frame member, wherein the frame member includes a plurality of walls arranged to define an enclosed area and the coupling means includes a housing member coupled to a first of the plurality of walls and positioned outside the enclosed area, the housing member including second means for receiving the locking means when the locking means is in the unlocking position and means for attaching the housing member to the frame member.

3. The mechanism of claim 2, wherein the blocking means includes means for visually indicating the position of the locking means, the indicating means being formed on the blocking means so as to extend beyond the coupling means when the locking means is in the locking position.

4. The mechanism of claim 2, wherein the locking means includes a latch pin positioned in the enclosed area, the latch pin having a first end positioned to extend through an aperture formed in the first wall to engage the first receiving means when the locking means is in the unlocking position.

5. The mechanism of claim 4, wherein the housing member includes a channel formed therein and the first receiving means is an elongated aperture, the housing member being positioned against the first wall so that the channel forms a cavity therebetween, the blocking means being positioned in the cavity for movement between a releasing position and a blocking position and including a solid portion and a distal end, the elongated aperture being aligned with the second receiving means when the blocking means is in the releasing position and the solid portion being aligned with the second receiving means when the blocking means is in the blocking position.

6. The mechanism of claim 2, wherein the housing member is positioned adjacent the first wall so that the channel cooperates with the first wall to form a cavity, the blocking means being positioned in the cavity and sized and oriented for gravity actuated movement between a releasing position for allowing the locking means to move to the unlocking position and a blocking position for retaining the locking means in the locking position.

7. The mechanism of claim 6, wherein the coupling means includes means for limiting the amount of gravity actuated movement, the limiting means extending between the housing member and the first wall and through an elongated aperture formed in the blocking means.

8. A latch mechanism for use in coupling a horizontal platform to a selected vertical position on a supporting structure, the mechanism comprising:

a frame member having a plurality of walls arranged to define an enclosed area, means for engaging the supporting structure to couple the frame member to the supporting structure, the engaging means being coupled to the frame member, means for locking the engaging means in engagement with the supporting member, the locking means being positioned in the enclosed area and coupled to the engaging means and movable between a locking position and an unlocking position, and means for blocking the locking means, the blocking means being coupled to the frame member and positioned outside of the enclosed area and movable between a blocking position to prevent movement of the locking means to the unlocking position and a releasing position to allow movement of the locking means to the unlocking position, the blocking means including aperture means for receiving the locking means.

9. The mechanism of claim 8, wherein the blocking means includes a housing member and means for coupling the housing member to the frame member outside the enclosed area, the housing member being formed to include a channel and positioned adjacent the frame member, the channel cooperating with the frame member to form a cavity between the housing member and the frame member.

10. The mechanism of claim 9, wherein the housing member includes an aperture for receiving the locking means and the blocking means includes a plate positioned in the cavity, the aperture being aligned with the locking means and the plate being sized and oriented for gravity actuated movement between the releasing position and the blocking position.

11. The mechanism of claim 10, wherein the plate includes a solid portion and an elongated aperture, the elongated aperture being positioned for alignment with the aperture formed in the housing member when the blocking means is in the releasing position and the solid portion being positioned for alignment with the aperture formed in the housing member to preventmovement of the locking means to the unlocking position when the blocking means is in the blocking position.

12. The mechanism of claim 10, wherein the plate includes an elongated aperture and the coupling means includes means for limiting the amount of gravity actuated movement of the plate, the limiting means extending from the housing member through the elongated aperture to the frame member.

13. The mechanism of claim 10, wherein the plate includes means for visually indicating the position of the locking means, the indicating means including a distal end formed on the plate and extending outside the cavity when the locking means is in the locking position.

14. The mechanism of claim 8, wherein the engaging means includes a longitudinal axis and the plurality of walls of the frame member includes first and second walls positioned in parallel spaced-apart relation to the longitudinal axis of the engaging means and a third wall extending between the first and second walls, the third wall forming an acute angle with the longitudinal axis of the engaging means.

15. The mechanism of claim 8, wherein the engaging means includes a longitudinal axis and the plurality of walls of the frame member includes first and second walls positioned in parallel spaced-apart relation to the longitudinal axis of the engaging means and a third wall extending between the first and second wall, the locking means being configured to be grasped by the hand of a worker, the intersection between the first and third walls defining ergonomic means for anchoring the hand of the worker when the hand grasps the locking means.

16. A latch mechanism for use in coupling a platform to a supporting structure, the mechanism comprising:

a frame member including a plurality of walls arranged to define an enclosed area, means for engaging the supporting structure to couple the frame member to the supporting structure, the engaging means being coupled to the frame member, means for locking the engaging means in engagement with the supporting member, the locking means being coupled to the engaging means, and means operated by gravitational forces for indicating that the locking means is in the locking position.

17. A latch mechanism for use in coupling a platform to a supporting structure, the mechanism comprising:

a frame member including a plurality of walls arranged to define an enclosed area, means for engaging the supporting structure to couple the frame member to the supporting structure, the engaging means being coupled to the frame member, means for locking the engaging means in engagement with the supporting member, the locking means being coupled to the engaging means.

means for indicating that the locking means is in the locking position, and wherein the engaging means includes a longitudinal axis and the plurality of walls includes first and second walls positioned in parallel spaced-apart relation to the longitudinal axis of the engaging means and a third wall extending between the first and second walls, the third wall forming an acute angle with the longitudinal axis of the engaging means.

18. The mechanism of claim 17, wherein the indicating means includes a housing member positioned adjacent the second wall outside the enclosed area, the housing member and second wall cooperating to form a cavity therebetween, and a plate positioned in the cavity, the plate having a distal end configured to extend outside the cavity when the locking means is in the locking position.

19. The mechanism of claim 18, wherein the plate is movable by gravity actuation between non-indicating position and an indicating position and includes an elongated aperture, the indicating means further including means for limiting the movement of the locking means, the limiting means extending from the housing member through the elongated aperture to the second wall.

20. A latch mechanism for use in coupling a platform to a supporting structure, the mechanism comprising:

a frame member including a plurality of walls arranged to define an enclosed area, means for engaging the supporting structure to couple the frame member to the supporting structure, the engaging means being coupled to the frame member, means for locking the engaging means in engagement with the supporting member, the locking means being coupled to the engaging means, means for indicating that the locking means is in the locking position, and wherein the indicating means is positioned outside the enclosed area.

21. The mechanism of claim 20 wherein the engaging means includes a longitudinal axis and the plurality of walls of the frame member includes first and second walls positioned in parallel spaced-apart relation to the longitudinal axis of the engaging means and a third wall extending between the first and second walls, the locking means being configured to be grasped by the hand of a worker, the intersection between the first and third walls defining ergonomic means for anchoring the hand of the worker which the hand grasps the locking means.

22. In a scaffolding latching mechanism for coupling a horizontal platform framework to a vertically extending supporting structure, the latching mechanism including a latch pin having a threaded disk rigidly attached thereto and a threaded nipple rigidly attached to the platform framework, the latch pin being configured to extend through aligned apertures formed in the platform framework and the supporting structure to assure a locking position, the threaded disk being configured to threadedly engage the threaded nipple to lock the latch pin in the locking position, the improvement comprising:

a plurality of walls arranged to define an enclosed area, the plurality of walls including first and second walls in parallel spaced-apart relation, the first and second walls including apertures for receiving the latch pin, the latch pin being positioned within the enclosed area so as to extend between the apertures in the first and second walls, a housing member attached to the first wall and positioned outside the enclosed area, the housing member and the first wall cooperating to define a cavity therebetween, the housing member including an aperture for receiving the latch pin, and a plate positioned in the cavity and including an elongated aperture and a solid portion, the plate being sized to move by gravity actuation from a latch pin-releasing position to a latch pin-blocking position.

23. This improvement of claim 22, wherein the plate further includes a distal end configured to extend out of the cavity when the plate is in the latch pin-blocking position.

24. The improvement of claim 23, further comprising means for attaching the housing member to the first wall, the attaching-means including means for limiting the amount of extension of the plate out of the cavity, the limiting means extending from the housing member through the elongated aperture to the first wall.

* * * * *